US005734120A

United States Patent [19]

Besselink

[11] Patent Number: 5,734,120

[45] Date of Patent: Mar. 31, 1998

[54] FIREARM LOCKING MECHANISM

[76] Inventor: Bernard Christian Besselink, 31 Switchback Road, Churchill 3842, Australia

[21] Appl. No.: 605,084

[22] PCT Filed: Dec. 9, 1994

[86] PCT No.: PCT/AU94/00762

§ 371 Date: May 31, 1996

§ 102(e) Date: May 31, 1996

[87] PCT Pub. No.: WO95/16178

PCT Pub. Date: Jun. 15, 1995

[30] Foreign Application Priority Data

Dec. 9, 1993 [AU] Australia ..... PM2867

[51] Int. Cl.[6] ..... F41A 5/04; F41A 5/26

[52] U.S. Cl. ..... 89/163

[58] Field of Search ..... 89/163, 195, 196, 89/162, 159

[56] References Cited

U.S. PATENT DOCUMENTS 2,372,542 3/1945 Bloomquist ..... 89/159

5,060,555 10/1991 Sater et al. ..... 89/196

5,309,815 5/1994 Moller et al. ..... 89/163

FOREIGN PATENT DOCUMENTS 76260 8/1953 Denmark ..... 89/196

*Primary Examiner*—Stephen M. Johnson

[57] ABSTRACT

A self-loading firearm operating on the short-recoil principle which comprises a frame having a handgrip and adapted to receive a magazine. A breech block slide is mounted for alternating longitudinal movement along the frame. A barrel is provided which is able to move rearwards while positively locked with the slide member by locking means. An actuating means disengages the barrel from the slide after the high pressure period has passed. A variable volume chamber means is fixed to the underside of the barrel which communicates with the barrel bore via a passage to receive pressurized gases upon firing. The action of the variable volume chamber means retards the motion of the barrel and slide assembly allowing a lighter slide to be used for a specific cartridge type.

6 Claims, 4 Drawing Sheets

FIREARM LOCKING MECHANISM

TECHNICAL FIELD

This invention relates to self-loading firearms and more particularly to self-loading pistols of the short-recoil-operated type.

Self-loading pistols receive the energy to operate their loading mechanism from the energy of recoil. The recoil force drives the slidable superstructure of the pistol rearward on a horizontal platform built into a lower frame to extract the spent cartridge case from the firing chamber and eject it from the pistol. The superstructure is then returned to the forward or battery position by a return spring and is adapted to strip the succeeding round from a magazine and insert it into the firing chamber. Subsequent shots may require discrete trigger operations in the case of semi-automatic pistols or the trigger to remain continuously depressed in the case of automatic pistols.

The self-loading pistols referred to above include pistols and machine pistols in contrast to other types of pistols which do not self-load such as revolvers.

BACKGROUND ART

Self-loading pistols can be divided into a number of types such as pure blowback, delayed blowback, gas-operated, short-recoil-operated and long-recoil-operated.

With pure blowback pistols, the slidable superstructure consists only of a breech block slide. The slide is not locked to the barrel and the barrel is fixed to the frame. Immediately after firing, the recoil force starts to drive the slide rearwards thus commencing the extraction of the spent cartridge case. Thus, part of the extraction occurs during the high pressure period of the firing cycle. If the slide is too light, the case is extracted too soon and case rupture will result, leading to a failure of the loading cycle and possible injury to the user. As a result, the pure blowback type can only be used with low-powered cartridges since there is a practical limit to the mass of the slide. This type, however, is cheap to make and is quite common.

There are also a number of pure blowback pistols which use a gas retarding arrangement attached to the slide, eg, the Steyr GB and Heckler & Koch P7. The arrangement reduces the effect of residual gas pressure on the motion of the breech block slide and buffers the stop of the breech block slide.

Residual gas pressure is the gas pressure left in the barrel after the projectile has left the barrel. Residual gas pressure occurs due to the time it takes for the gas left in the barrel to leave via the muzzle. Although the residual gas pressure is low compared to the pressures when the projectile is moving in the barrel, it may persist for longer. The residual gas pressure can thus have a substantial influence on the recoil of the slide.

One such gas retarding arrangement consists of a piston attached to the slide and a cylinder attached to the frame. It should be noted that the stroke of the piston needs to be the same length as the travel of the slide. The cylinder is connected by a passage to the barrel bore. After firing, a small amount of propellant gas is bled into the cylinder. As the slide recoils, the piston attached compresses the bled propellant gas, thus producing a retarding force. It should be noted that the bullet has left the barrel by the time that this retarding process occurs, and so it should not be called a delayed blowback system as some do call it. A true delayed blowback process operates while the bullet is still in the barrel. As well, the initial case extraction still occurs during the high pressure period of the firing cycle.

With delayed blowback pistols, the slidable superstructure comprises a breech block slide but, as well, it has a delaying mechanism. The delaying mechanism is usually based on leverage in order to magnify the effective recoiling mass of the superstructure for a short period, thus reducing the extent of extraction of the spent cartridge case during the high pressure period of the firing cycle. This type can be used with more powerful cartridges but is quite expensive to make and is generally not cost competitive with the short-recoil-operated type.

With gas-operated pistols, the slidable superstructure comprises a breech block slide, and the pistol has a gas chamber and piston, eg, the Wildey Automatic Pistol. The slide is locked to the barrel and the barrel is fixed to the frame. The gas chamber is connected by a passage to the barrel bore. After firing, the projectile travels along the barrel and passes the entrance to the passage and gas is bled into the chamber. The gas pressure drives the piston to actuate an unlocking mechanism after the high pressure period has passed. The slide is unlocked from the barrel after the bullet has left the barrel. The breech block slide starts its rearward motion and begins extraction of the spent cartridge case using the energy provided by the piston and the residual gas pressure in the barrel. After extraction, the spent cartridge case is ejected. The slide continues until full travel is reached. The cartridge case, therefore, does not move while the bullet is in the barrel. Since the case is not able to move relative to the barrel until the slide is disengaged from the barrel and the operation is not dependent on the mass of the slidable superstructure, this type is used for very powerful cartridges. However, this type is complex and costly and is not commonly used.

With short-recoil-operated pistols, the slidable superstructure consists of a barrel and a breech block slide. Prior to the firing of the cartridge, the barrel is engaged to the breech block slide by a locking means. After firing, the recoil force drives both the slide and barrel rearwards, but since they are in engagement, the extraction of the case has not started. After the high pressure period has passed, an actuator begins to disengage the barrel from the slide. The barrel travels a short distance before coming to rest forward of the magazine, hence short-recoil, and is completely disengaged from the slide. The breech block slide continues and begins extraction of the spent cartridge case using its kinetic energy and the residual gas pressure in the barrel. After extraction, the spent cartridge case is ejected. The slide continues until full travel is reached. The cartridge case, therefore, does not move while the bullet is in the barrel. Since the case is not able to move relative to the barrel until the barrel is disengaged from the slide, this type is used for relatively powerful cartridges. However, revolvers are generally needed for the most powerful pistol cartridges; since again, there is a practical limit to the mass of the barrel and slide on short-recoil-operated pistols.

In short-recoil-operated pistols, the barrel may be locked to the breech block slide by a number of locking means. The barrel may be provided with peripheral ribs, studs, lugs or other means and may be rotated, cammed or otherwise engaged and disengaged from the slide. Alternatively, a separate locking block may be used to lock the barrel to the slide.

Common methods include the tilting barrel method of locking and the falling block method of locking. Examples of the former are the US Model 1911A1 pistol and the FN Browning 9 mm High Power: examples of the latter are the Walther P38 and Beretta Model 92.

In the tilting barrel method of locking, the muzzle end of the barrel is slidably and tiltably mounted at the forward end of the slide. The locking means comprises a number of transverse locking ribs located on the rear upper surface of the barrel and a number of mating locking slots on the slide member. Actuating means act to operate the locking means to disengage the barrel from the slide by urging the rear end of the barrel downwards.

In the falling block method of locking, the barrel is slidably mounted for straight line axial motion, and the locking means comprises a separate locking block provided with means for engaging the barrel to the slide. The actuating means comprises a cam on the frame operative to cam the locking block downwardly from engagement with the slide during initial rearward movement of the slide from the battery position and upwardly to engage the slide during final movement of the slide to the forward battery position.

Generally, the main components of a short-recoil-operated pistol are made of steel. A number of pistols use aluminium or polymer materials for the frame. However, the use of materials other than steel for the breech block slide is limited due to the lower density of these other materials. Because of practical size limitations, the use of lower density materials results in a slide of lower mass affecting the recoil behaviour of the pistol, when the same power cartridge is used.

A limitation in short-recoil-operated pistols of current design is the need for the barrel and slide mass to provide inertia. This factor controls the minimum mass of the arm in relation to the power of the ammunition used. In the past, the long recoil system was used for high powered pistols but this has been invalidated by experience. In long-recoil-operated pistols, the recoiling barrel and breech block slide are in engagement for a distance of about the length of a cartridge before disengagement is brought about. It is unnecessarily complicated for use in a weapon intended to be fired from one hand.

In contrast to the prior art pistols, it is the object of the present invention to provide a short-recoil-operated pistol with a lower mass recoiling superstructure relative to the power of the ammunition used than in conventional designs. It has previously been thought that self-loading short-recoil pistols were unsuitable for use with powerful ammunition. In the past, persons skilled in the art made use of gas-operation with self-loading pistols in order to use powerful cartridges.

DISCLOSURE OF INVENTION

Essentially a self-loading firearm of the short-recoil-operated pistol type according to the invention comprises a frame having a handgrip adapted to be grasped by the user and a receiver in the frame adapted to releasably receive a magazine. The magazine is adapted to be inserted into the receiver. A breech block slide member is slidably mounted for alternating longitudinal movement along the frame between a forward battery position and a rearward fully retracted position. The slide member carries a firing mechanism and is adapted to strip the succeeding round from the magazine. A barrel is provided which is adapted to move rearwards while positively engaged with the slide member. After disengagement from the slide member the rear end of the barrel comes to rest forward of the magazine. A locking means is provided which positively engages the barrel and the slide member during the high pressure period of the firing cycle. An actuating means mounted below the barrel acts to operate the locking means in order to disengage the barrel from the slide member after the high pressure period has passed and to engage the barrel with the slide member on the return of the slide member to the battery position.

Furthermore, one or a number of variable volume chamber means fixed to the underside of the barrel are provided. A chamber means communicates with the barrel bore via a passage or passages such that propellant gases act to increase the pressure in a variable volume chamber means after the start of the motion of the projectile along the barrel bore. The resulting pressure increase in a chamber means provides a force to act substantially along a longitudinal axis to act on the frame in order to retard the motion of the barrel while engaged with the slide member. A return spring urges the slide member to return to the battery position.

When the pistol according to the invention is fired, the projectile begins to move forward along the barrel bore and the recoil force starts to drive the barrel and breech block slide rearward together. As the projectile moves further forward, it passes and uncovers the entrance or entrances to the passage or passages. As a result, some of the propellant gases are able to pass into one or a number of variable volume chamber means. The pressure of the propellant gases provides the force for a chamber means to act against the frame of the pistol. Since the chamber or chambers are fixed to the barrel and the barrel is locked to the slide member, this action provides a force on the recoiling members opposite to the recoil force. The force from a return spring is also present. Thus, the motion of the recoiling barrel and slide is retarded. The rearward motion of the barrel acts to decrease the volume of a variable volume chamber means.

After the high pressure period has passed, the actuating means acts to operate the locking means in order to begin the disengagement of the barrel from the slide member. The barrel continues until it reaches its rearmost position which is forward of the magazine and disengagement is complete. The one or a number of variable volume chamber means are now at their lowest volume. The slide member continues rearward but its motion is not influenced by the chamber or chambers, since the barrel is now completely disengaged from the slide member. The slide member extracts the spent cartridge case and ejects it from the pistol. The breech block slide member continues until it reaches its rearward fully retracted position. The return spring is now in its most compressed state.

The compressed return spring urges the slide member forward. As the slide reaches the magazine, the succeeding round is stripped from the magazine in the usual manner and inserted into the firing chamber. The face of the breech block slide contacts the breech opening of the firing chamber and the barrel is urged forward from its rearmost position. The barrel begins its engagement to the slide via the locking means and under the action of the actuating means. The loading cycle is completed on the return of the barrel and the slide member to the battery position. The volume of a variable volume chamber means is now at its maximum.

The number of the variable volume chamber means provided depends on the final design adopted. For example, two of the variable volume chamber means may be provided symmetrically about the centreline of the pistol in order to reduce the vertical dimensions or to place the load bearing areas closer to the sides of the frame. The number of passages to a particular variable volume chamber means may depend on the profile of pressure increase required. Since there is initially a gas flow between the barrel bore and a variable volume chamber means, the length and cross-sectional area of the passages determines the rate of equilibration of pressure between the two. The dimensions depend on the pressure profile required. A passage may be a circular hole, a longitudinal slot or other orifice.

Since some propellant gas is bled from the barrel bore and is not available for propelling the projectile, the muzzle velocity for a given cartridge type and barrel length is marginally reduced. The peak pressure in the barrel is also reduced if the passage is revealed before the peak pressure is reached. This would normally be the case. Since the effective stroke of a variable volume chamber means is related to the travel of the barrel and not of the slide, the effective volume of a variable volume chamber means is relatively small. It should be noted that the muzzle velocity to weight ratio for a pistol according to the invention is superior to that of a conventional self-loading pistol. The characteristics of a self-loading pistol according to the invention are such that the further the entrance to a passage is along the barrel bore, the higher the muzzle velocity, but the larger the effective cross-sectional area of a variable volume chamber means needs to become in order to maintain the same recoil behaviour.

As already mentioned, the prior art use of a gas cylinder retarding arrangement attached to the slide of blowback pistols has long been known. However, it has never been apparent to persons skilled in the art to utilise a gas chamber attached to the barrel of a short-recoil pistol in order to reduce the mass of the slidable superstructure.

The advantage of the present invention with respect to gas-operated self-loading pistols is that the present invention provides a solution to the problem of using relatively powerful ammunition but is less complex in construction and relatively lighter.

The first preferred embodiment of the invention comprises a self-loading firearm of the short-recoil-operated pistol type in which the locking means is of the tilting barrel locking type. Typically in this embodiment, the forward end of the breech block slide member surrounds the barrel. The muzzle end of the barrel is slidably and tiltably mounted in a mounting at the forward end of the slide. The locking means comprises one or a number of transverse locking ribs located substantially on the rear upper surface of the barrel and one or a number of mating locking slots on the slide member which are fully engaged when in the battery position. The actuating means acts to operate the locking means in order to disengage the barrel from the slide member while in rearward motion by urging the rear end of the barrel downwards.

In a variation of the above embodiment, the actuating means comprises a lug located below the barrel. The lug has a rearwardly sloping cam slot having parallel sides for its upper end and an axially aligned cam face toward its rear end adapted to engage a cam pin mounted in the frame. As a result, the barrel is movable in a straight line rearwards during the high pressure period of the firing cycle and thereafter the rear end of the barrel is urged downwards in order to separate the transverse locking ribs from the mating locking slots thus disengaging the barrel from the slide. On return to the battery position, the actuating means reverses the process to engage the barrel to the slide via the locking means.

Another actuating means which may be used in the above embodiment comprises one or two barrel links attached to the barrel and attached to the frame. As a result, the barrel is movable substantially in a straight line rearwards during the high pressure period of the firing cycle and thereafter the rear end of the barrel is urged downwards in order to separate the transverse locking ribs from the mating locking slots thus disengaging the barrel from the slide.

It should be clear to a person skilled in the art that there are other combinations of conventional cams, cam slots and grooves which can be combined with other camming surfaces, pins and protuberances to produce the required urging downwards of the rear end of the barrel as described above and not require a change to the novel features of the invention.

A second preferred embodiment of the invention comprises a self-loading firearm of the short-recoil-operated pistol type in which the locking means is of the falling block locking type. The barrel of this embodiment is slidably mounted for straight line axial motion along the frame independently from the slide member. The locking means comprises a separate locking block accommodated substantially beneath the underside of the barrel. The locking block is provided with means for engaging the barrel to the slide during the high pressure period of the firing cycle. The actuating means comprises a cam means on the frame operative to cam the locking block downwardly from engagement with the slide during the initial rearward movement of the slide from the battery position and upwardly to engage the slide during final movement of the slide to the forward battery position.

A preferred form of a variable volume chamber means which may be used in any of the embodiments is a piston and cylinder arrangement. With this arrangement, the cylinder may be the component of the variable volume chamber means which is fixed to the barrel and the piston may provide the means to transmit the force resulting from the propellant gas pressure to the frame. Alternatively, the piston may be fixed to the barrel and include the passage connecting the chamber means with the barrel bore, and the movable cylinder provides the means to transmit the force resulting from the propellant gas pressure to the frame.

It should be clear that the self-loading firearm according to the invention is provided with a locking mechanism specifically to allow the use of a breech block slide of a lower mass than is conventionally used for a specific ammunition type. As a result, a self-loading pistol according to the invention using common pistol ammunition, such as 9 mm Parabellum, is able to have a slide of a lower mass than normally used. Alternatively, it implies that a pistol according to the invention of similar dimensions and materials to those pistols currently used is able to use a more powerful cartridge.

In the case of a slide of lower mass, materials of a lower density may be used. Low density materials include materials of a suitable strength and a specific gravity of less than 3.0, examples are polymers and composite polymers, die-cast metals and aluminium alloys. Examples of polymer materials are polyetherimide polymer or composite polymers having polymers combined with teflon, glass or graphite materials.

An advantage in using polymers or die-cast metals is that the processing of such materials by injection moulding is less costly than that of machining steel. Another advantage in being able to use polymer materials is that these materials are non-corrosive and self-lubricating. With some types of ammunition, the barrel and variable volume chamber means may also be made of polymer materials or other low density materials.

The slide may also be of a composite construction having a subunit of the breech block slide member comprised of a breech block slide face with a forward extension adapted to engage the locking means constructed of a high strength material, such as steel. The rest of the slide is constructed of a low density material and carries the subunit.

The lightweight slide resulting from the current invention is intended to be used with a lightweight frame made from a polymer material, aluminium or other low density materials as is used in a number of current pistol designs.

A further benefit of the current invention is that for pistols made of conventional materials such as steel, the net force on the breech block is less; and so, if used in automatic fire mode, the recoil behaviour of the pistol will be more controllable, having a reduced cyclic rate and a breech block slide with lower kinetic energy and momentum. This arrangement will also allow shorter barrel travel if desired.

The dimensioning of all components of a firearm according to the invention will depend on the materials used and would be clear to a person skilled in the art. As well, a firearm according to the invention may be designed to operate as a closed breech or open breech weapon. Although not all the alternative arrangements are shown or specifically described, all of them must be considered to be within the scope of the invention.

BRIEF DESCRIPTION OF DRAWINGS

The construction and operation of preferred embodiments of the subject invention will be more fully understood from a reading of the following detailed description as illustrated by the accompanying drawings. The embodiments shown in the drawings are only given by way of example and in no way limit the scope of the present invention. The drawings are described as follows.

BEST MODE FOR CARRYING OUT THE INVENTION

Figure 1:
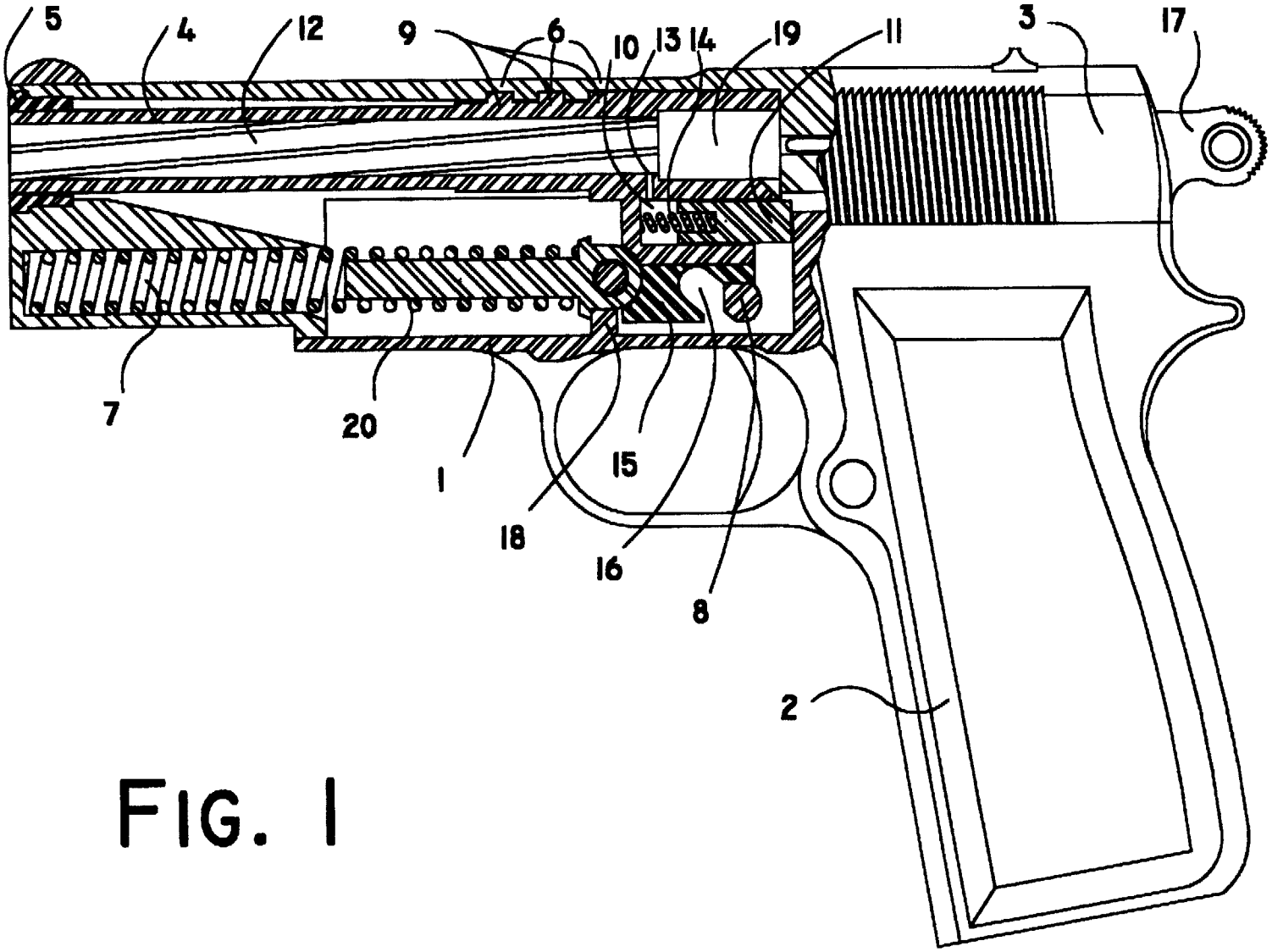
FIG. 1 represents a side elevation of a pistol according to the invention, with a longitudinal cross-sectional view of the forward part of the pistol, and with the breech block slide member in the battery position and hammer not cocked.
Figure 2:
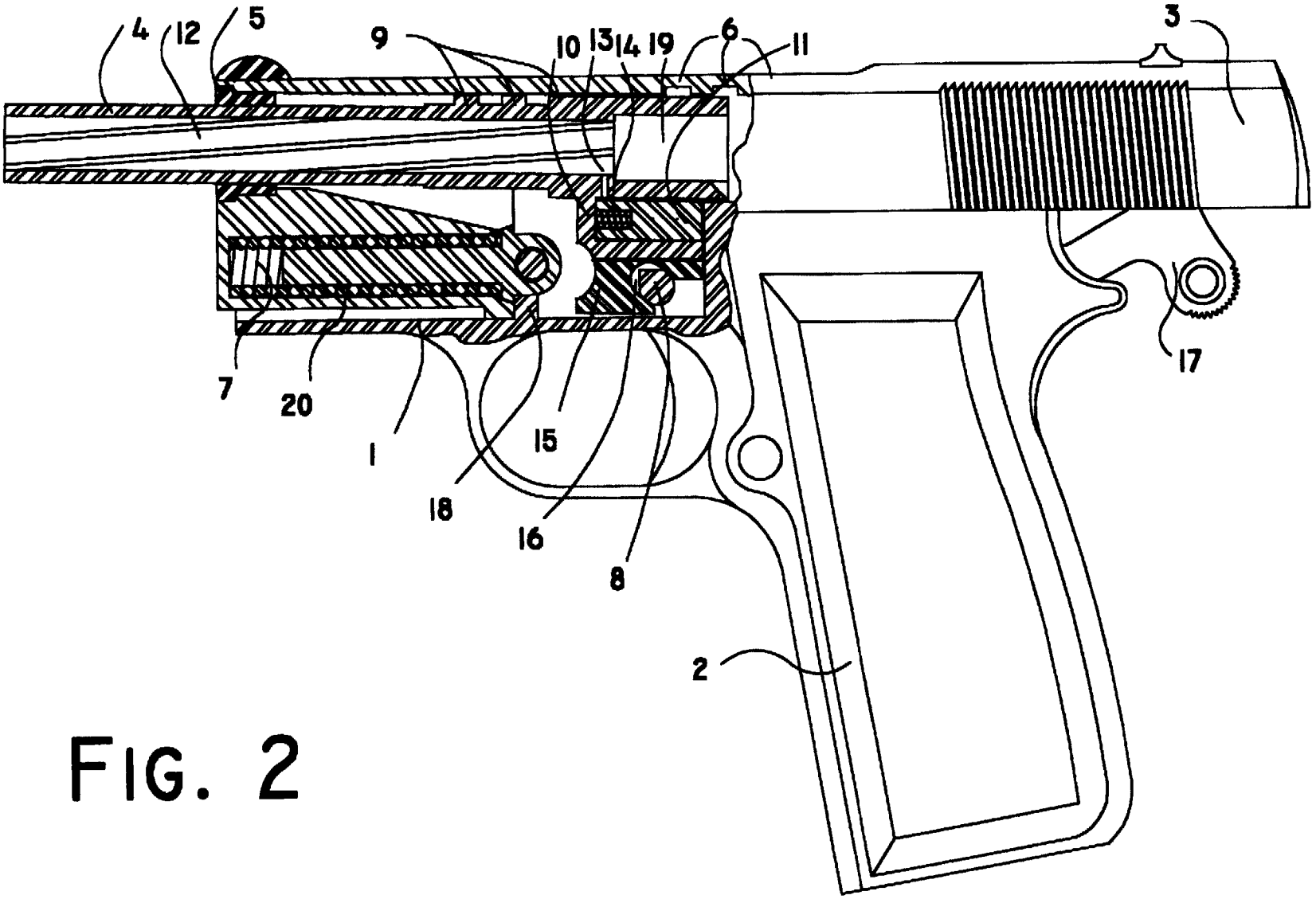
FIG. 2 represents a side elevation of a pistol according to the invention, with a longitudinal cross-sectional view of the forward part of the pistol, and with the breech block slide member in the fully retracted position, the barrel fully rearward and the hammer cocked.

As shown in FIGS. 1 and 2, the illustrated self-loading firearm embodying the subject invention is of the short-recoil-operated pistol type using the tilting barrel method of locking with an actuating means consisting of a lug with a cam slot. As such, the illustrated firearm has the overall configuration of a number of well-known pistols. The general features of magazine, and trigger, hammer and firing mechanism are well-known and readily apparent to persons skilled in the art and, therefore, will not be described in detail herein.

The self-loading firearm illustrated in FIGS. 1 and 2 comprises a frame 1 having a handgrip 2 including a receiver adapted to receive a magazine. A breech block slide member 3 mounted for alternating longitudinal movement along frame 1 surrounds the barrel 4 and has a mounting 5 of a bush type at its forward end adapted to allow the muzzle end of the barrel to slide through and to act as a pivot so that the barrel is able to tilt in the vertical plane. The breech block slide member 3 has effectively three locking slots 6 approximately midway along the slide on the underside of the slide. The breech block bears a firing device (not shown). The lower forward end of the slide is adapted to carry the forward end of the return spring 7 and is able to telescope into the forward end of the frame 1.

A barrel is carried in the slide and is borne on the mounting 5 and the cam pin 8 so that the barrel is able to move rearwards while positively locked with the slide member 3. The barrel 4 has effectively three transverse locking ribs 9 located substantially on the upper surface of the barrel 4 forward of the firing chamber. The locking slots 6 and the transverse locking ribs 9 comprise the locking means.

As shown in FIGS. 1 and 2, the subject invention differs to conventional pistols in that it has the novel feature of a variable volume chamber means comprising a cylinder 10 fixed to the barrel (in this case integral with the barrel) and a movable piston 11 which is able to act on the frame 1. The piston 11 and cylinder 10 have a substantially longitudinal axis. The cylinder is able to communicate with the barrel bore 10 via a passage 13. The piston 11 substantially maintains contact with the frame 1 when not under the influence of propellant gas pressure by the action of a spring 14.

The actuating means comprises, firstly, a lug 15 which has a cam slot 16 and is fixed to the cylinder 10 and, secondly, a cam pin 8 mounted to the frame 1. The cam slot 16 has an axially aligned cam face toward its rear end which rides on the top surface of the cam pin 8 when in the battery position (as shown in FIG. 1). The upper end of the cam slot has rearwardly sloping parallel sides at about 45 degrees. The upper end engages the cam pin 8 to draw the rear end of the barrel 4 downwards to disengage the barrel 4 from the slide 3 (as shown in FIG. 2).

As FIGS. 1 and 2 show, the subject invention is provided with a helical coil compression recoil spring 7 mounted below and axially parallel with the barrel 4. It should be noted that the trigger mechanism is mounted rearwards of the magazine, as in many conventional pistol designs.

Figure 3:
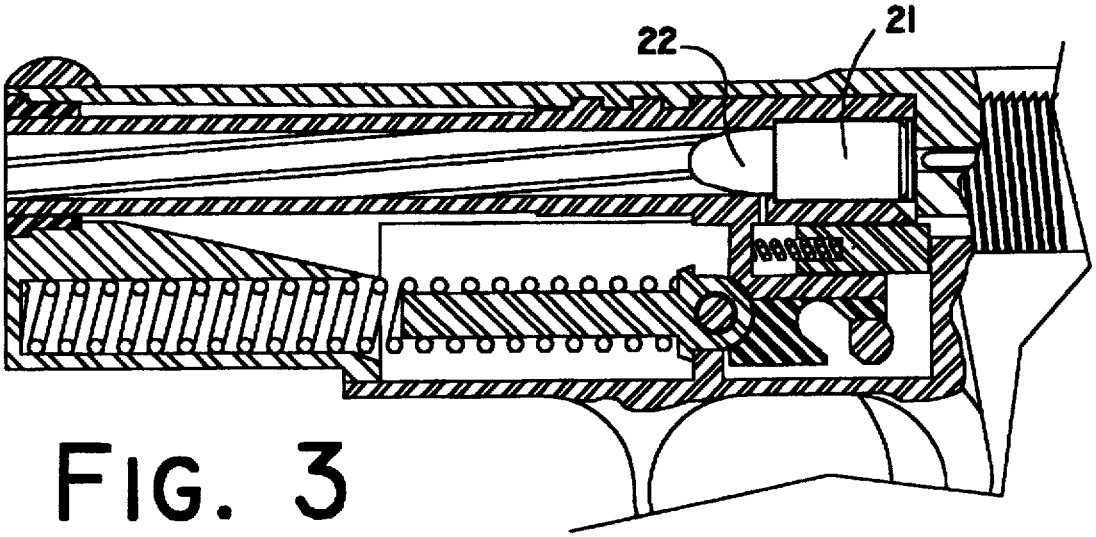
FIGS. 3 to 5 inclusive each represent a longitudinal cross-sectional view of the forward part of a pistol according to the invention and show the relationship between projectile position in the barrel bore and the position of various parts of the pistol.
Figure 4:
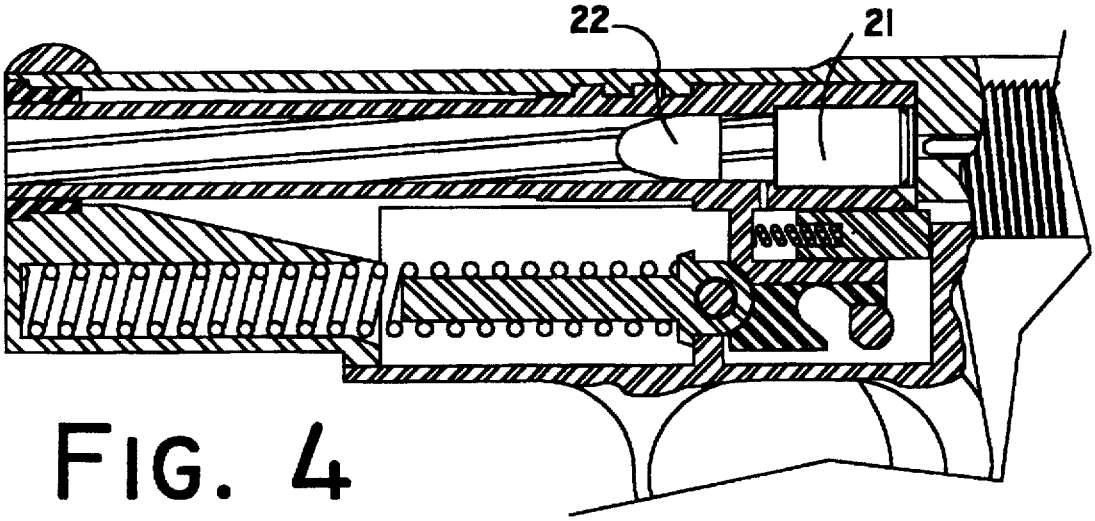
Figure 5:
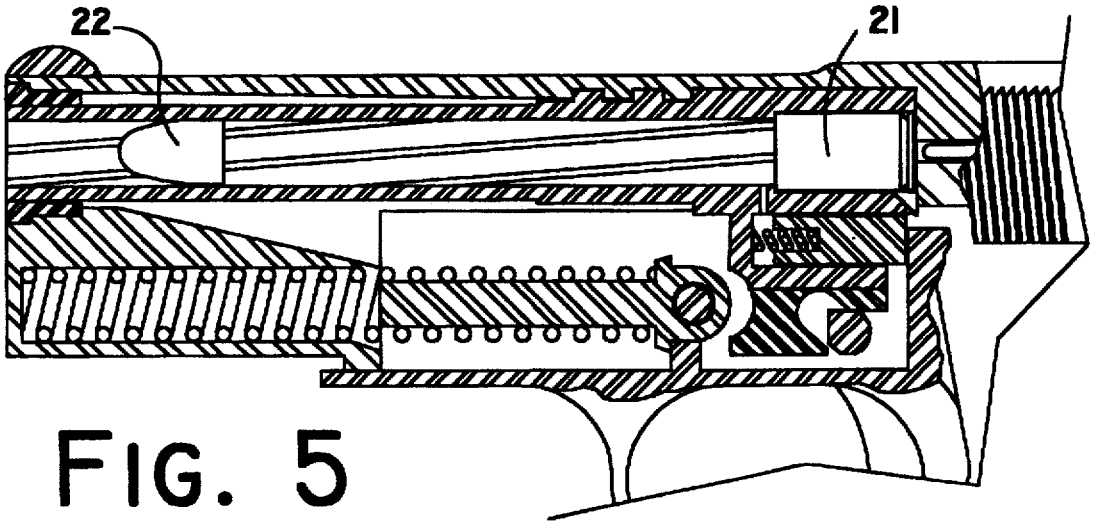
Figure 7:
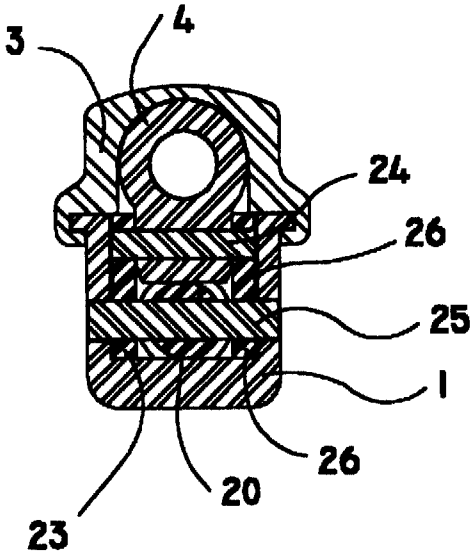
FIG. 6 represents a longitudinal cross-sectional view of the forward part of a pistol according to the invention using a double barrel link and FIG. 7 represents a transverse cross-sectional view at the barrel links.

The general operation of the pistol allows the firing of a round and as the projectile begins to move forward, the recoil starts to drive the barrel 4 and breech block slide 3 rearward. FIG. 3 shows the cartridge case 21 and projectile 22 in the firing chamber 19 before firing and the positional relationship between the projectile 22 and the passage 13. As the projectile 22 moves further forward, it passes and uncovers the entrance to the passage 13, as shown in FIG. 4. Some of the propellant gases pass into the cylinder 10 increasing the pressure and thus the force that the piston 11 is able to apply to the frame 1. This force opposes the recoil forces and thus retards the motion of the recoiling barrel 4 and slide 3. As the barrel 4 moves rearwards, the piston 11 moves into the cylinder 10 to decrease its volume. During the high pressure period, as shown in FIGS. 4 and 5, the barrel 4 rides rearwards on the top surface of the cam pin 8 via the axially aligned cam face of the cam slot 16 and this constrains its motion to being directly rearwards. By the time the high pressure period has passed, the cam pin 8 has engaged the upper end of the cam slot and the barrel is urged downwards as well as continuing rearwards because the front camming surface of the cam pin 8 bears against the front surface of the cam slot 16. The downwards motion of the barrel 4 acts to disengage the transverse locking ribs 9 from the locking slots 6. By the time the lug 15 has reached its rearmost and most downward position, the slide 3 has completely disengaged from the barrel 4. The barrel 4 has reached its rearmost position and the cylinder 10 is at its lowest volume. The slide 3 continues rearward to extract the spent cartridge case and eject it from the pistol. The slide 3 continues until it cocks the hammer 17 and obtains its rearward fully retracted position where the return spring 7 is fully compressed and the lower forward end of the slide hits the slide stop 18. This final condition is shown in FIG. 2.

The compressed return spring 7 urges the slide 3 forward. As the slide 3 reaches the magazine, the succeeding round is stripped from the magazine in the usual manner. The round is inserted into the firing chamber 19 while the barrel 4 is in its rearmost position. The face of the slide 3 contacts the breech opening of the firing chamber 19 and the barrel is urged forward from its rearmost position. The barrel is urged upwards as well as continuing forward because the rear camming surface of the cam pin 8 bears against the rear surface of the upper end of the cam slot 16. The upwards motion of the barrel 4 acts to engage the transverse locking ribs 9 with the locking slots 6. The spring 14 urges the piston 11 substantially to maintain contact with the frame 1. When the locking engagement is complete, the barrel continues forward riding on the top surface of the cam pin 8 via the axially aligned cam face of the cam slot 16. The barrel 4 comes to rest on hitting the stop provided by the spring guide 20. The barrel 4 and slide 3 have completed the operational cycle and returned to the battery position and the weapon is cocked and ready for firing. The volume of the cylinder 10 is again at its maximum.

Figure 6:
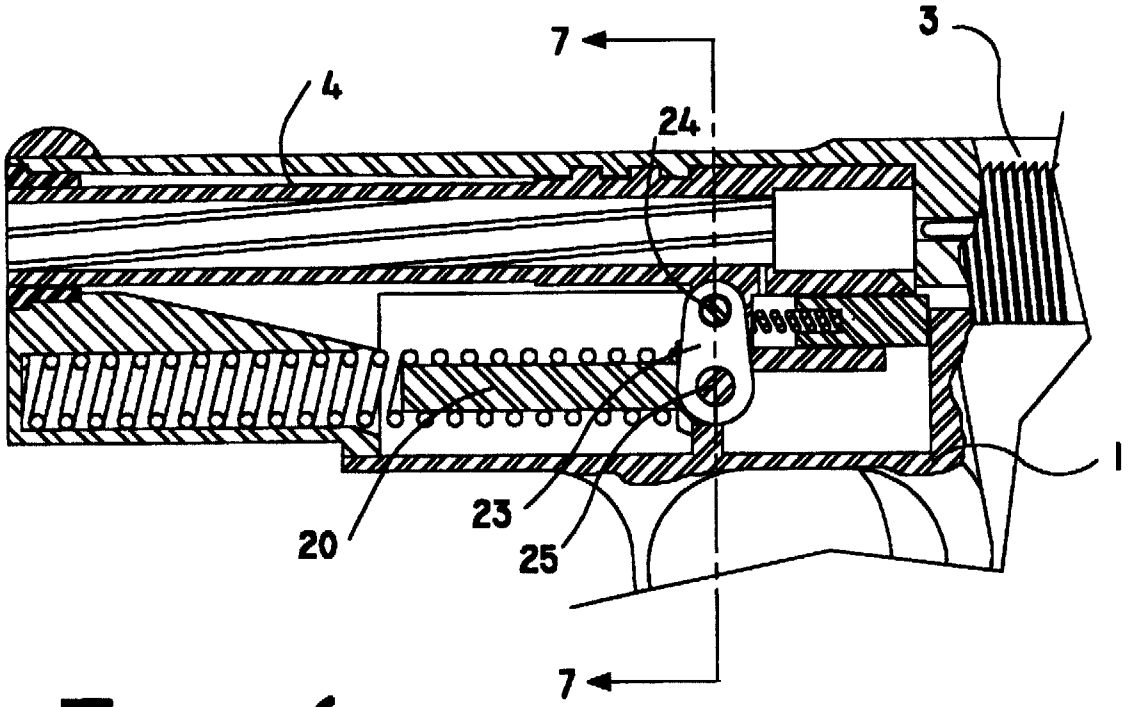

A variation of the above embodiment is shown in FIG. 6 and represents the use of two barrel links as the actuating means. The left barrel link 23 and the right barrel link 26 are connected to the frame 1 by the lower link pin 25 and to the barrel 4 by the upper link pin 24.

The invention is not intended to be limited to the specific form of the embodiment shown, which is presented for illustrative purposes only. Rather, it contemplates all of the variations and modifications coming within the scope of the claims.

I claim:

1. A self-loading firearm of the short-recoil-operated pistol type comprising a frame having a handgrip adapted to be grasped by the user;

a receiver in said frame adapted to releasably receive a magazine;

a magazine adapted to be inserted into said receiver;

a breech block slide member slidably mounted for alternating longitudinal movement along said frame between a forward battery position and a rearward fully retracted position where said slide member carries a firing mechanism and is adapted to strip the succeeding round from the said magazine;

a barrel adapted to move rearwards while positively engaged with the said slide member and where after disengagement from the said slide member the rear end of said barrel comes to rest forward of the said magazine;

a locking means which engages the said barrel and the said slide member during the high pressure period of the firing cycle;

an actuating means mounted below the said barrel which acts to operate the said locking means in order disengage the said barrel from the said slide member after the high pressure period has passed and to engage said barrel with said slide member on the return of the said slide member to the battery position;

one or a number of variable volume chamber means fixed to the underside of the said barrel where a said chamber means communicates with the barrel bore via a passage or passages such that propellant gases act to increase the pressure in a said variable volume chamber means after the start of the motion of the projectile along the barrel bore and where the resulting pressure increase in a said chamber means provides a force to act substantially along a longitudinal axis to act on the said frame in order to retard the motion of the said barrel while engaged with the said slide member; and a return spring which urges the said slide member to return to the battery position.

2. A self-loading firearm according to claim 1 of the tilting barrel locking type wherein the forward end of the said breech block slide member surrounds the said barrel and the muzzle end of the said barrel is slidably and tiltably mounted in a mounting at the forward end of the said slide member.

the said locking means comprises one or a number of transverse locking ribs located substantially on the rear upper surface of the said barrel and one or a number of mating locking slots on the said slide member when in the battery position; and the said actuating means acts to operate the said locking means in order to disengage the said barrel from the said slide member while in rearward motion by urging the rear end of the barrel downwards.

3. A self-loading firearm according to claim 2 wherein the said actuating means comprises a lug located below the said barrel where the said lug has a rearwardly sloping cam slot having parallel sides for its upper end and an axially aligned cam face toward its rear end adapted to engage a cam pin mounted in the frame such that the said barrel is movable in a straight line rearwards during the high pressure period of the firing cycle and thereafter the rear end of the said barrel is urged downwards in order to separate the said transverse locking ribs from the said mating locking slots thus disengaging the said barrel from the said slide member and where on return to the battery position the said actuating means reverses the process to engage the said barrel to the said slide member via the locking means.

4. A self-loading firearm according to claim 2 wherein the said actuating means comprises one or two barrel links where a said barrel link is attached to the said barrel and attached to the said frame such that the said barrel is movable substantially in a straight line rearwards during the high pressure period of the firing cycle and thereafter the rear end of the said barrel is urged downwards in order to separate the said transverse locking ribs from the said mating locking slots thus disengaging the said barrel from the said slide member.

5. A self-loading firearm according to claim 1 wherein each of the said variable volume chamber means is a piston and cylinder arrangement.

6. A self-loading firearm according to claim 5 wherein the said cylinder is fixed to the said barrel and the said piston acts on the said frame.

* * * * *